United States Patent [19]

Pontoppidan et al.

[11] Patent Number: 4,898,103

[45] Date of Patent: Feb. 6, 1990

[54] DESK CONSTRUCTION

[75] Inventors: Eskild Pontoppidan, Copenhagen, Denmark; Willy Fleischer, Neukircher Mühle 26, D 4300 Essen, Fed. Rep. of Germany, 16,BRD

[73] Assignees: Willy Fleischer, Bocum, Fed. Rep. of Germany; Metallwarenfabrik GmbH & Co. KG

[21] Appl. No.: 207,271

[22] Filed: Jun. 15, 1988

[30] Foreign Application Priority Data

Jun. 16, 1987 [DK] Denmark ..... 3058/87
May 19, 1988 [DE] Fed. Rep. of Germany ..... 3817102

[51] Int. Cl.[4] ..... A47B 9/00
[52] U.S. Cl. ..... 108/144; 108/136
[58] Field of Search ..... 108/144, 136; 267/249, 267/256; 248/123.1

[56] References Cited

U.S. PATENT DOCUMENTS

| | | | |
|---|---|---|---|
| 2,137,662 | 11/1938 | Alvarez | 267/256 |
| 2,356,924 | 8/1944 | Froelich | 108/144 |
| 2,982,050 | 5/1961 | May | 108/136 |
| 3,370,556 | 2/1968 | Kooi | 108/136 |
| 3,820,478 | 6/1974 | Bergenthal | 108/136 |
| 3,941,440 | 3/1976 | Morzin et al. | 108/136 |
| 4,351,245 | 9/1982 | Laporte | 108/136 |
| 4,747,353 | 5/1988 | Watt | 108/144 |

*Primary Examiner*—Francis K. Zugel
*Attorney, Agent, or Firm*—McGlew & Tuttle

[57] ABSTRACT

A desk has a vertically adjustable top and at least one vertical guide member movable upwardly and downwardly on a support or frame. A spring leg is disposed between the frame and vertically adjustable desk components. The spring leg is pivoted at one end to a guide member and its other end is braced against a curved rail. The braced end is movable on the rail and lockable in positions corresponding to accommodate various loads on the desk top. The curve of the rail is chosen so that in any position of the braced spring end, the vertical components of force acting on the guide member are equal, at least in two opposite end positions of the desk top. This results in equilibrium in each vertical position for every load on the desk top, after the spring leg has been adjusted.

9 Claims, 7 Drawing Sheets

DESK CONSTRUCTION

FIELD AND BACKGROUND OF THE INVENTION

The invention relates in general to a desk, more particularly for a video display unit (VDU) or computer workstations, comprising at least one vertically adjustable desk top having at least one vertical guide member, a desk frame having a vertical guide for the guide member and a spring leg disposed between the desk frame and vertically adjustable desk elements A constant problem in the case of vertically adjustable desks is to set the desk top at the height desired at a particular time, particularly when the desk top is loaded, e.g. by a VDU or computer or typewriter or the like. In such cases the operator needs to use considerable force. The desk top is locked, after being adjusted to the desired height, by a locking brake. In order to reduce the force needed for vertical adjustment, in the case of a vertically adjustable desk, the top is braced against the desk frame by a pneumatic spring. The spring is dimensioned so that its force slightly exceeds the maximum load expected on the on the desk top. The pneumatic spring also has a locking means and an actuating lever in order to lock the spring piston and consequently the desk top in any position after vertical adjustment. This known embodiment is disadvantageous in that the pneumatic spring cannot be adapted to varying loads on the desk top. Furthermore, the vertical components of force on the vertical guide means for the desk top vary with the vertical position of the desk top. This applies particularly to the top and bottom end position thereof Consequently, the desk top is not in equilibrium in any vertical position, and the operator making a vertical adjustment must always use his own methods to compensate some part of the load on the desk top. Operation is therefore not as easy as desired, and this is the concern of the invention.

SUMMARY OF THE INVENTION

The invention provides a vertically adjustable desk, more particularly for VDU workstations, having a top which is extremely easy to adjust vertically, independently of the load thereon at any time.

According to the invention, one end of a spring leg is pivoted to a vertical guide member and the other end is braced at a preset adjusting angle to a curved rail on the desk frame. The braced spring end is movable by an adjusting device on the curved rail and it is lockable in positions adapted to varying loads on the desk top, and the curve of the rail is so chosen that, in any position of the braced spring end, the vertical force components acting on the guide member are substantially equal, at least in the two end positions of the desk top. According to the invention, an equilibrium mounting, as it were, is provided for a vertically adjustable desk, since the vertical force components are substantially equal at practically any position of the desk top between the two end positions. Depending on the adjustment of the spring leg on the curved rail to the load on the desk top at a particular time, the top, assisted by the spring leg, can be vertically adjusted with minimum effort by the operator. A locking brake, which is provided in conventional manner, is used only for securing the desk top in the set equilibrium position. The curve of the rail depends on the desk construction, the adjustment angle of the spring leg and the spring characteristic thereof. The choice of the spring leg and consequently of its spring characteristic, in turn, depend on the expected maximum load on the desk top. The variable bracing of the spring leg against the curved rail results in a prestress on the spring leg adapted to each load on the desk top. The spring force is transmitted to the guide member, depending on the adjustment angle of the spring leg, so that the operative vertical force components are in fact approximately equal at every vertical position of the desk top. Deviations, if any, are less than the frictional resistance in the device for guiding the desk top.

The invention also relates to a desk, more particularly for VDU workstations, comprising at least one vertically adjustable desk top and a frame comprising columns made up of vertical bottom parts and top parts telescopable therein, and a cross-member connecting the bottom parts and comprising a device for vertically adjusting the telescopic parts, which bear on the desk top.

In the desk construction, the vertical adjusting device comprises a spring leg and a driving wheel. One end of the spring leg is pivoted in a stationary position and the other spring end is braced at a present adjusting angle against a pivotably mounted curved rail. A connecting lever is mounted on the curved rail so as to pivot in the opposite direction to the direction of action of the spring leg. The lever is operatively connected to a driving wheel by a flexible tension means which can be wound on and off the shaft of the driving wheel. The braced end of the spring leg is movable by an adjusting device on the curved rail and lockable in positions adapted to various loads on the desk top. The curve of the rail is so chosen that, in any position of the braced spring leg, the vertical force components acting on the top parts of the columns are substantially equal, at least in the two end positions of the desk top. This desk construction achieves the same technical effects as in the preceding embodiment. The only difference is in the suspension of the spring leg and the transmission of spring force to the means for guiding the desk top, with the interposition of a driving wheel. The basic solution however, is the same.

Other inventive features are disclosed hereinafter. According to the invention, for example, the spring leg is constructed as a pneumatic spring in which, as is known, the compressibility of gas is used for resilience. Preferably the curved rail is a double rail and one end of the pneumatic spring has rollers on both sides bearing against the double rail, to obtain substantially stable bracing of the pneumatic spring. According to another recommended feature, the device for adjusting the braced spring end is a worm drive with a hand wheel or crank and the nut for a stationary mounted spindle is connected to the braced spring end. The worm drive is self-locking, so that the pneumatic spring cannot adjust automatically to the curved rail, but the work drive also locks the braced spring end in the set position.

The first embodiment of the desk can also have two vertical guide members, in which case advantageously the pneumatic spring is centrally pivoted on a cross-member connecting the two guide members. Preferably, the guide member or members on the side of the pneumatic spring are braced against the desk frame via parallelogram guide rods. This results in efficient vertical guidance of the guide members and a defined transmission of spring force.

In the case of the second embodiment of the desk, according to the invention, the pneumatic spring, the driving wheel, the curved rail, the adjusting device, the connecting lever and the tension means operatively connecting the lever to the driving wheel or shaft thereof constitute a structural unit and are combined in a box-shaped casing having an external driving wheel and a crank connection for the adjusting device. The vertically adjusting unit can, without difficulty, be incorporated in the frame of a vertically adjustable desk, e.g. at the cross-member. Optionally, the driving wheel is a pinion for a rack or drive shaft of a mechanism for actuating the telescopic column parts or the desk top. According to a preferred embodiment of the invention, however, an endless cable is connected to the driving wheel and the telescopic upper parts and the cable is guided on pulleys mounted at the top and bottom of the column bottom parts, and the cable is associated with a locking brake. A cable of this kind has two adjacent guide pulleys at the top of the bottom part of the columns, whereas at the bottom only one pulley is necessary, disposed at right angles to the adjacent coaxial guide pulleys at the top. The locking brake can operate on the cable at any desired place. Preferably, the flexible tension means between the connecting cable and the driving wheel is a steel cable or plastics cable and is connected to a ground reel secured to the shaft for the driving wheel, so that the cable is efficiently guided. The groove is centrally aligned on the connecting lever, which can be a double lever and is pivotably mounted at the end of t he curved rail, which is double. The pivoting bearing for the other end of the curved rail is advantageously a shaft for actuating the spindle of the worm drive and constitutes the crank connection emerging from the casing.

According to the invention, both embodiments of the vertically adjustable desk can simply be a lifting device for easy vertical adjustment of any loads.

Accordingly, it is an object of the invention to provide a desk construction which comprises a desk top which is guided for vertical movement on a support or frame which provides a guide for a vertical guide member which is secured to or made a part of the desk top. The construction includes a curved rail member connected to the support and a spring leg member which has one end connected to the vertical guide and an opposite other end which bears against the rail member on a portion of a curved surface thereof. An adjustment device is connected to at least one of the rail member and spring leg in order to shift the rail member and the spring member relatively in order to vary the position of the spring member portion which bears against the rail member so as to position the parts for equilibrium in each vertical position of every load on the desk top after the spring leg is adjusted.

A further object of the invention is to provide a desk construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
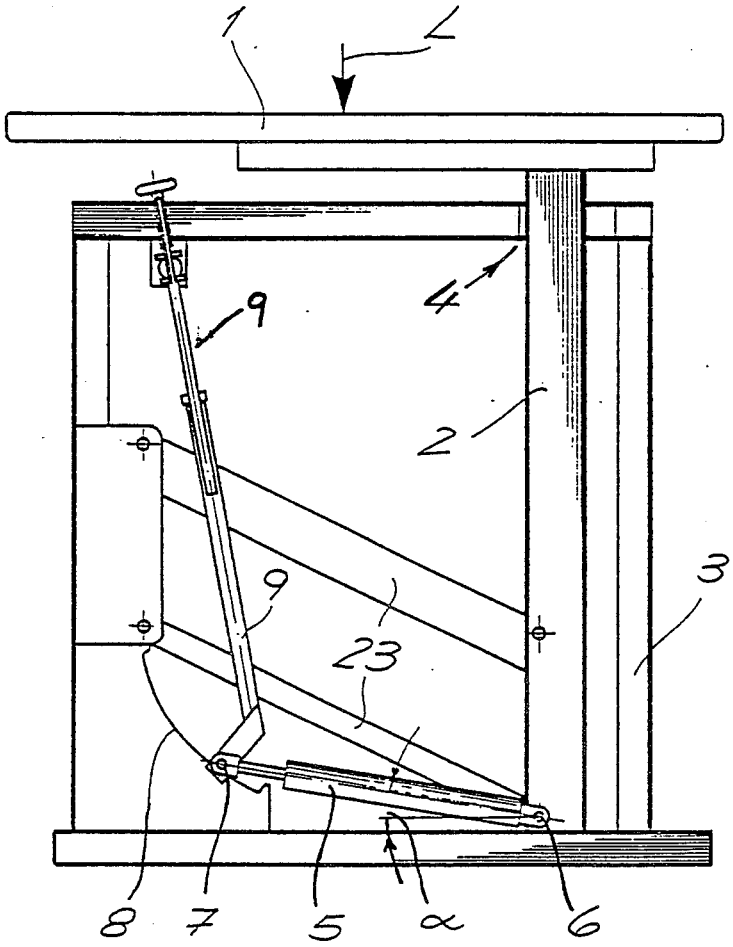
FIG. 1 is a diagrammatic side elevational view of a first embodiment of a vertically adjustable desk constructed in accordance the invention.

Referring to the drawings in particular, the invention embodied therein comprises a desk which includes a desk top 1 which is either formed integrally with or connected to a vertical guide member 2 which is guided in a slot 4 of a frame 3 and adjusted for upward and downward vertical movement by parallel connecting arms 23 having their one end secured to the frame 3 and the opposite ends secured to the vertical guide member 2.

In accordance with the invention, a spring leg 5 has one end connected to the vertical guide 2 which is designated 6 and an opposite end 7 which is formed so that it may be braced against or bear against a curved surface of a curved rail 8. Adjustment means 9 are provided for adjusting the position of the other end 7 of the telescopic leg member or spring leg 5 which bears against the curved rail 8. The embodiment of FIGS. 4 to 8 provides for the pivotal mounting of the rail guide 8' for aid in the bracing of the end 7 of the spring leg 5 against the rail 8' rather than the fixed rail surface of the curved rail 8 of the embodiment of FIGS. 1 to 3. In addition, the embodiment of FIGS. 5 to 8 provide for different guide structure for the vertical guidance of the desk top 1' which includes opposite leg portions 11, 11 which ride in receiving portions of hollow legs 10, 10.

Figure 2:
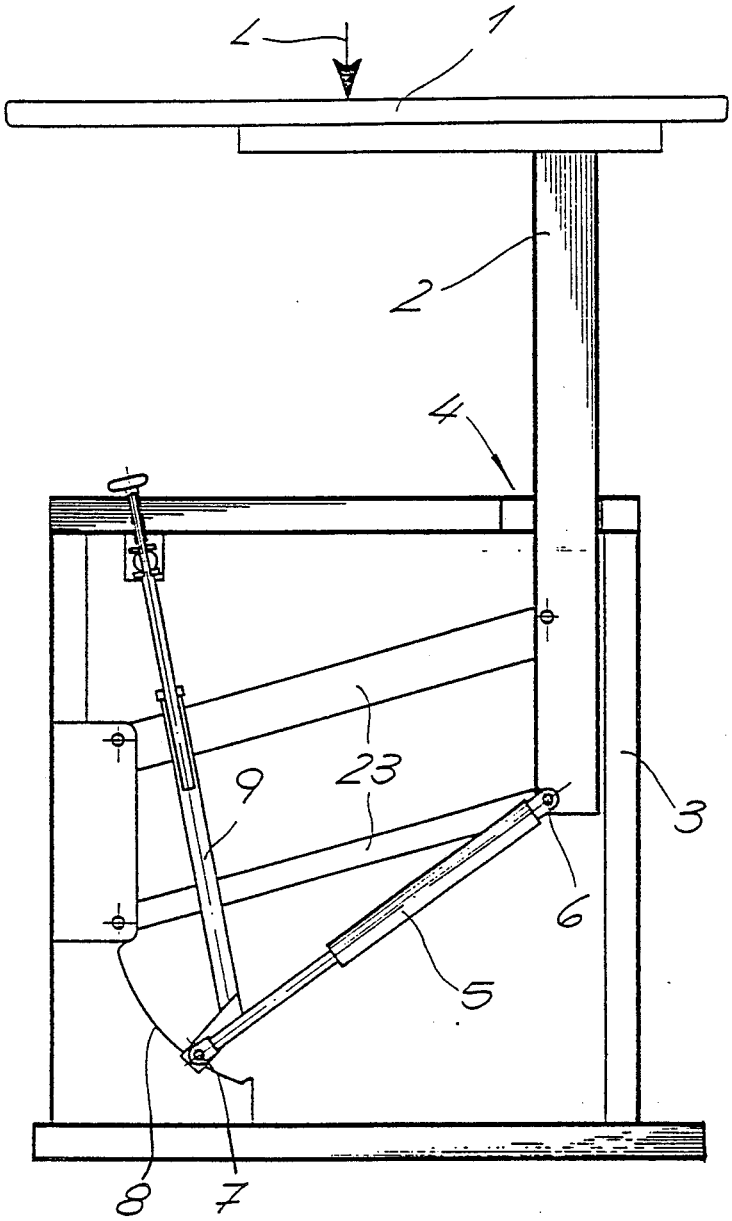
FIG. 2 is a view similar to FIG. 1, indicating the desk top in a raised position.

FIGS. 1 and 2 show a desk, more particularly for VDU workstations, comprising at least one vertically adjustable top 1 and at least one vertical guide member 2, and a desk frame 3 with a vertical slot or guide 4 for member 2 and a spring leg 5 disposed between frame 3 and the vertically adjustable desk top 1 and guide 2. One spring end 6 of leg 5 is pivoted to the guide 2 and the other spring end 7 is braced at a preset adjustment angle alpha to a stationary curved rail 8 on the desk frame 3. The braced spring end 7 is movable by an adjusting device 9 on rail 8 and it is lockable in positions adjusted to varying loads on the desk top. The curve of rail 8 is adjusted so that, in any position of the braced spring end 7, the force components P1,P2 acting on member 2 are substantially equal, at least in both end positions of top 1 and also in intermediate vertical positions.

Figure 3:
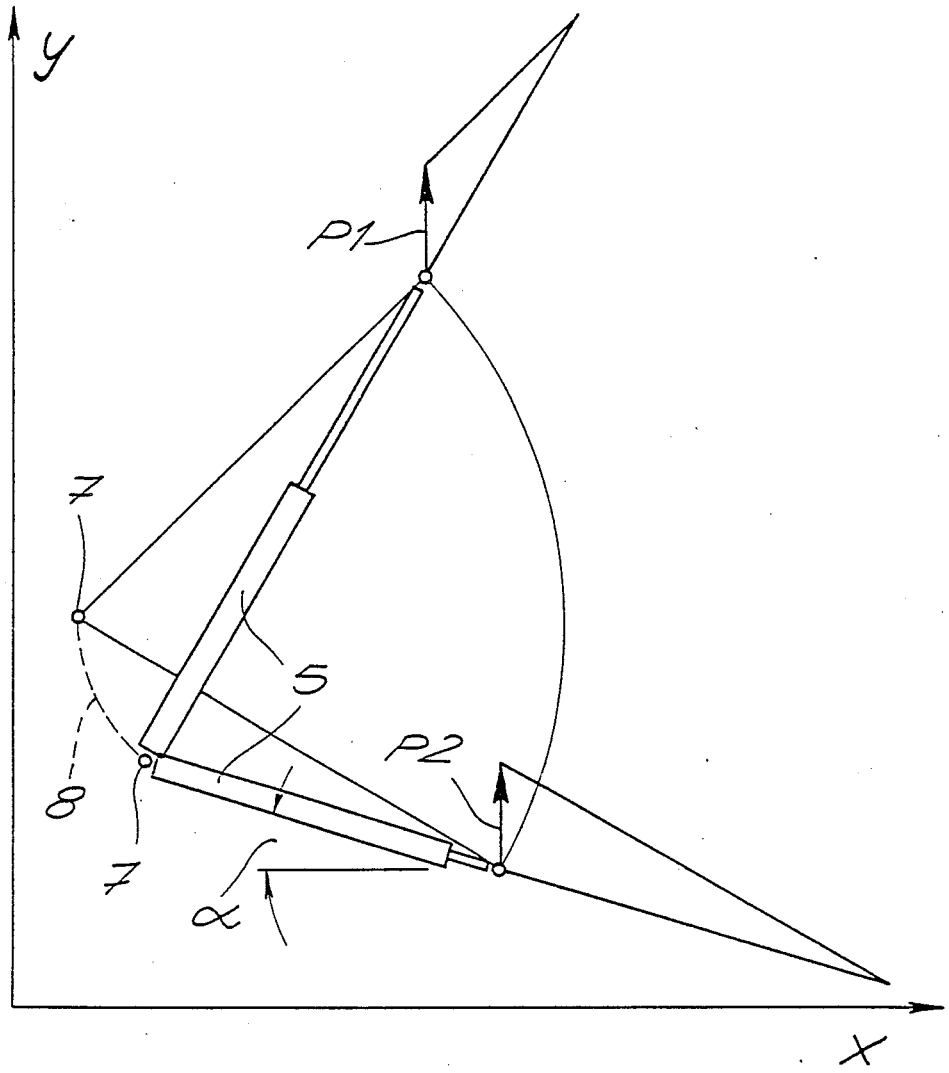
FIG. 3 is a vector diagram showing the spring leg 5 into end positions.
Figure 4:
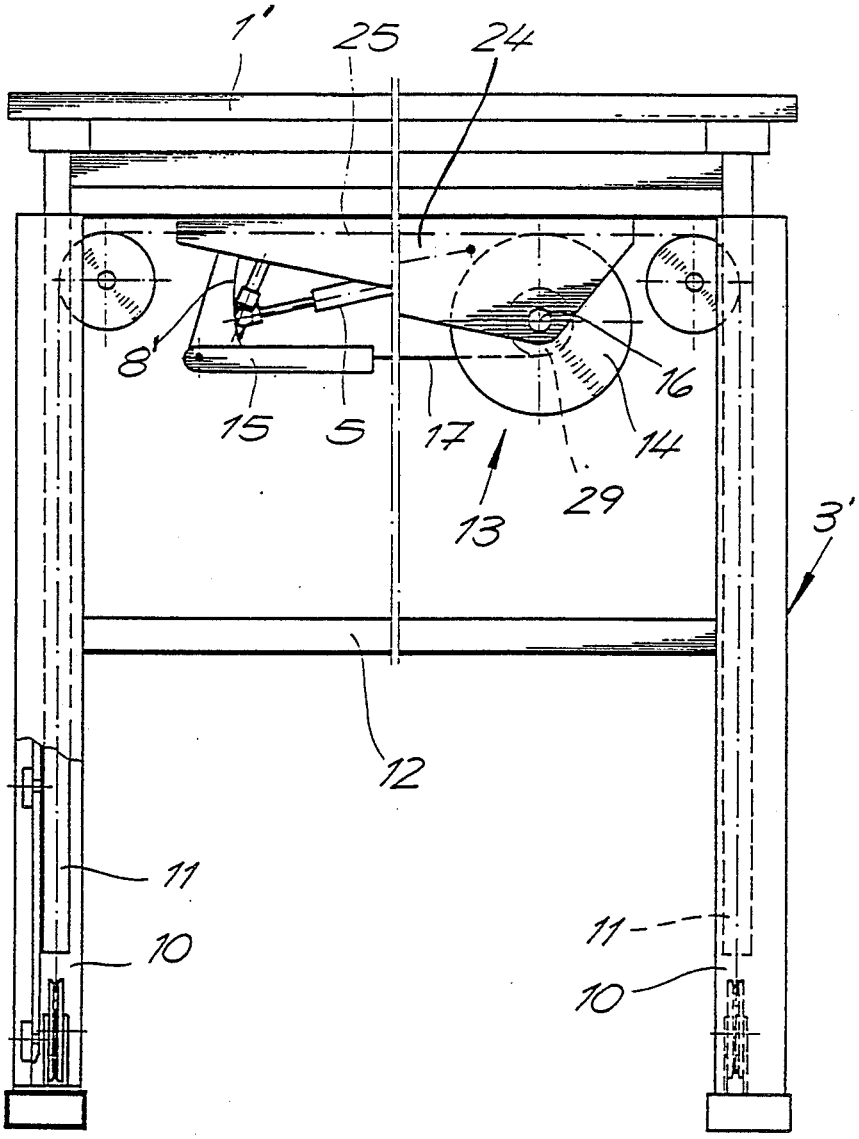
FIG. 4 is a view similar to FIG. 1 of a second embodiment of a vertically adjustable desk comprising a vertical adjustment unit, in and partly in section.
Figure 5:
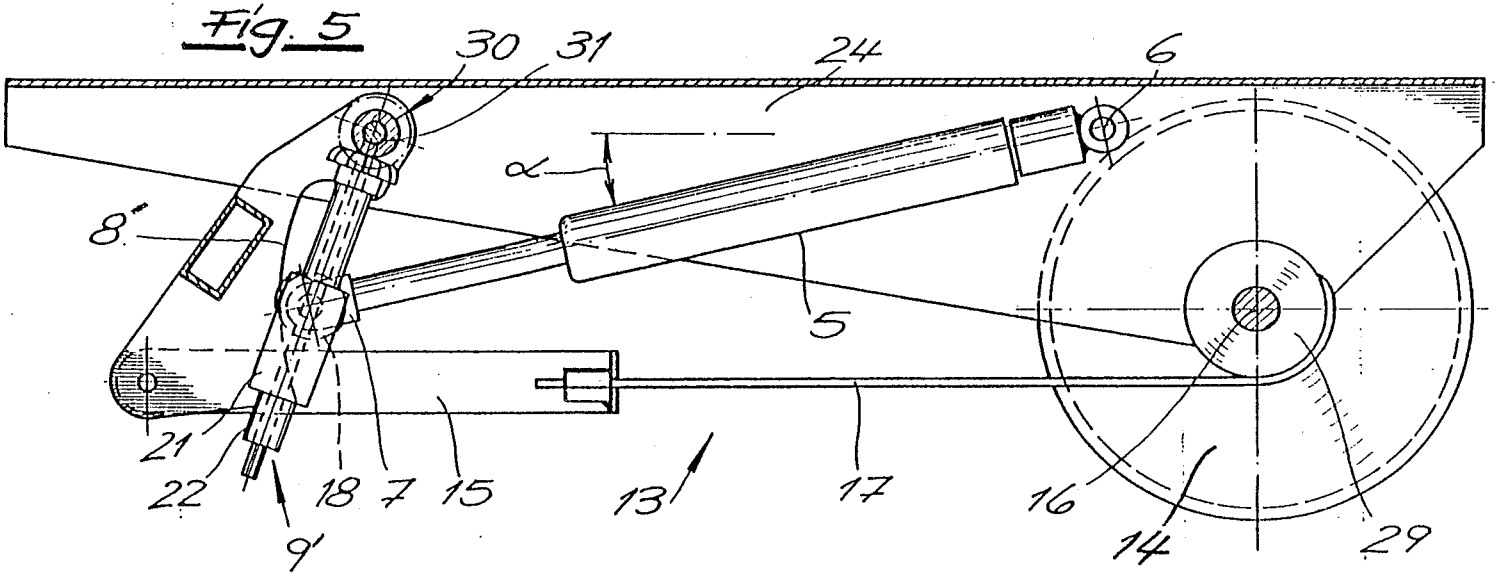
FIG. 5 shows the vertical adjustment unit for the device shown in FIG. 4, after removing the casing side walls.
Figure 6:
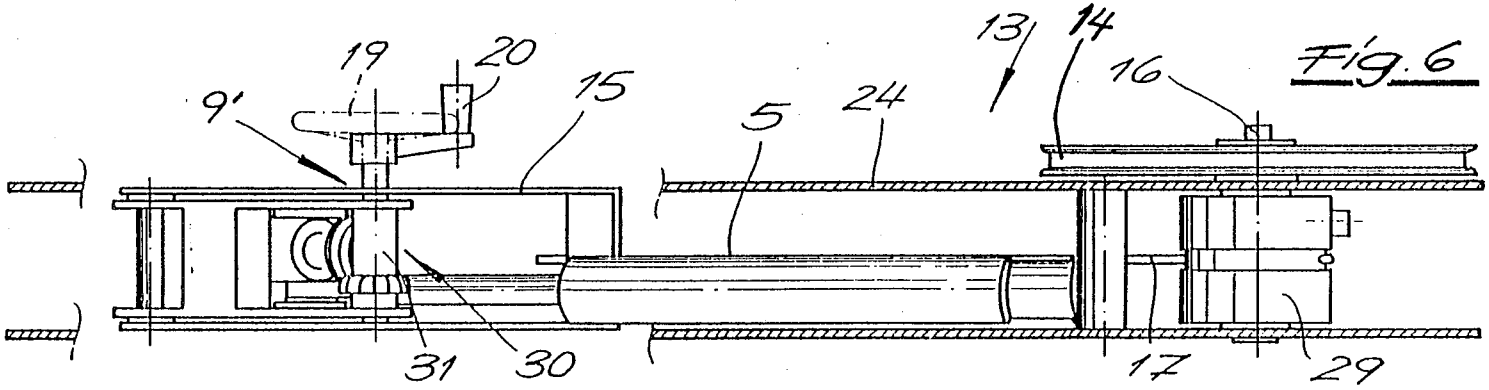
FIG. 6 the device of FIG. 5 in elevation, after removing the casing cover.
Figure 7:
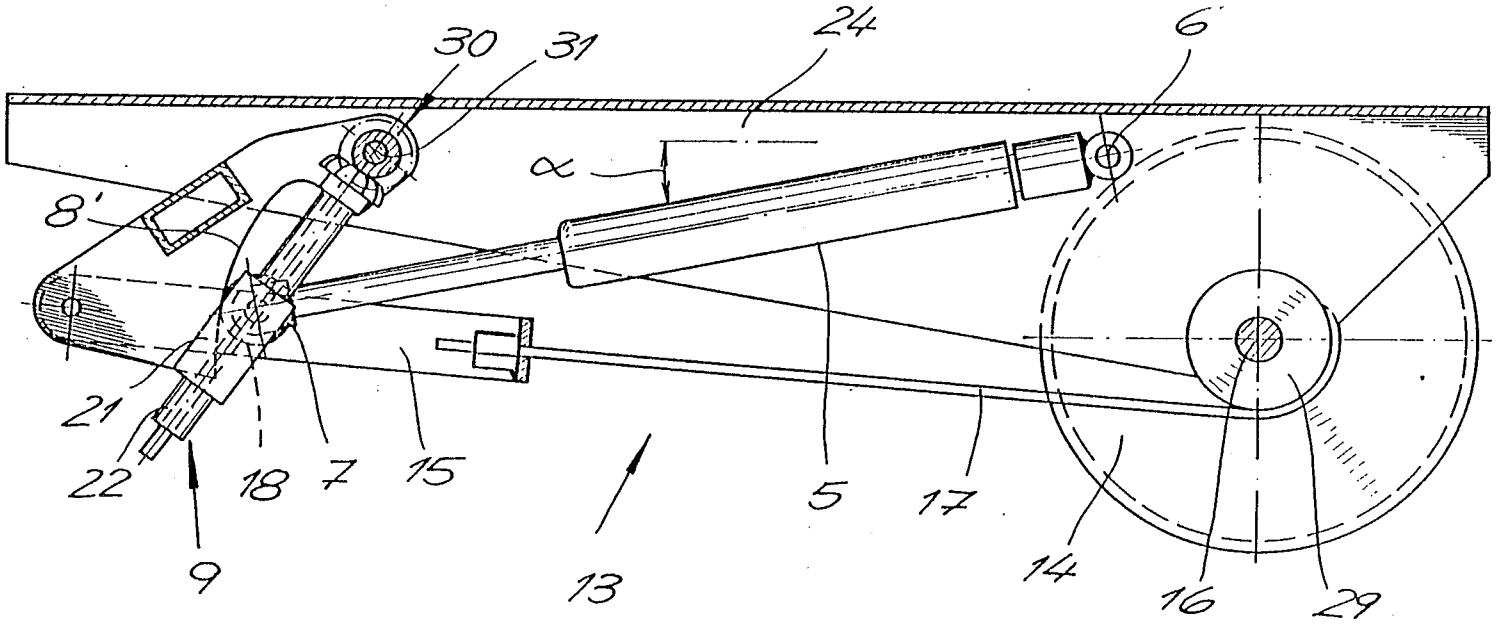
FIG. 7 shows the article in FIG. 5, when the desk top is in the bottom position.
Figure 8:
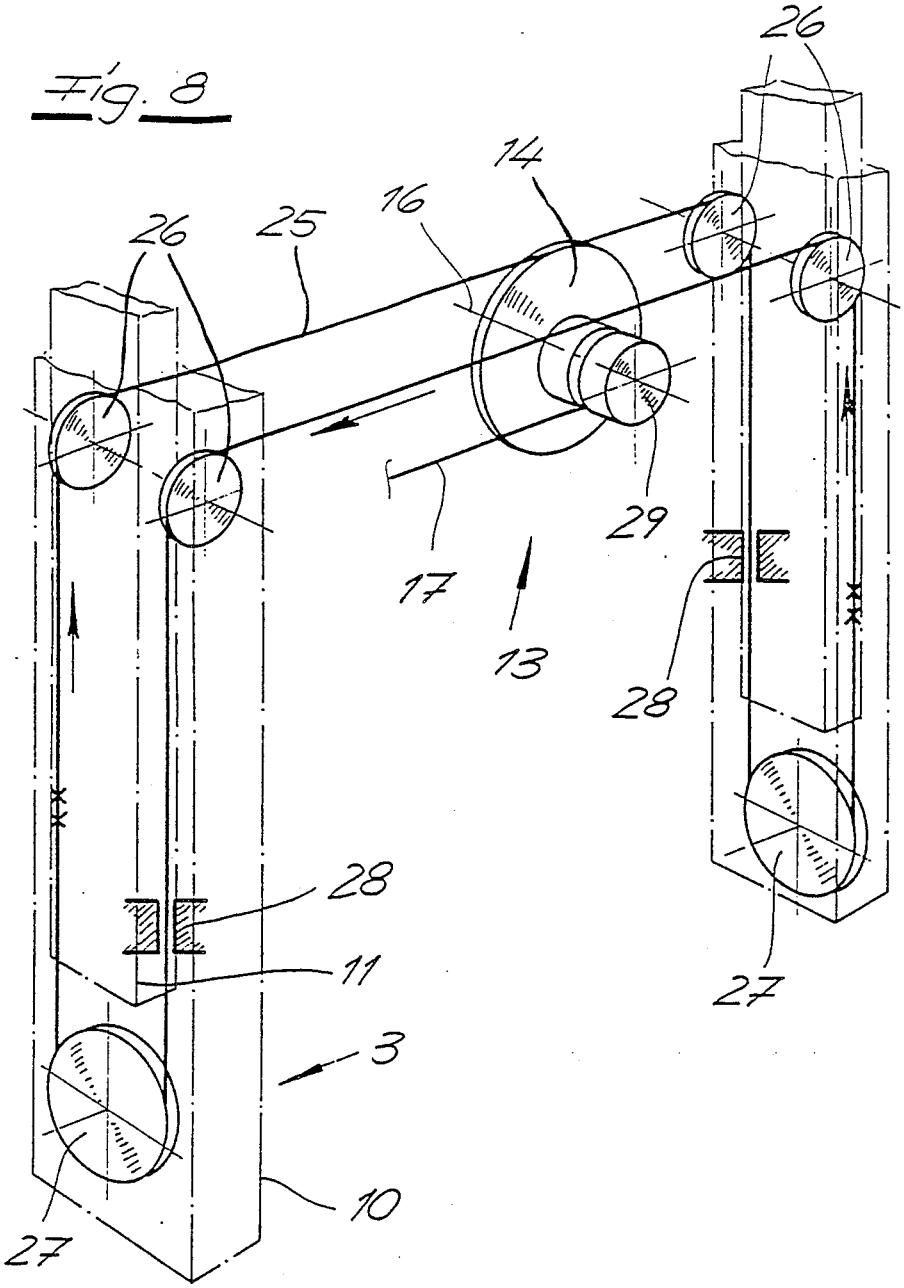
FIG. 8 is a perspective diagrammatic view of the cable guide for the article in FIG. 4.

FIG. 3 is a vector diagram showing the spring leg 5 in both end positions, i.e. the end positions of desk top 1. The respective force components P1, P2 are shown in the directions of action of spring leg 5. When the load L on top 1 decreases, the braced spring end 7 moves to the left along the x coordinate, thus reducing the operative spring force., In order however, to ensure that the vertical force components P1,P2 remain equal, the braced spring end 7 must also move by a preset amount in the direction of the y coordinate. The curve of rail 8 can be determined in various ways, e.g. by means of the coordinate system shown, in which, for various values of x, the adjustment angle alpha of spring leg 5 and the spring force thereof in the corresponding angular positions, those values of y are determined at which the two vertical force components P1 and P2 are equal. In that case, for each load on desk top 1 within the preset load range, the spring end braced on the curved rail has a position in which the vertical force components P1 and P2 are in fact equal.

FIGS. 4 to 8 show a vertically adjustable desk in a variant embodiment, i .e. with at least one vertically adjustable desk top 1' and a frame 3' comprising columns having upright lower parts 10, upper parts 11 telescoping therein and a cross-member connecting the parts 10 and comprising a device 13 for vertically adjusting the telescopic upper parts 11, which carry the desk top 1'. In this variant, the vertical adjusting device 13 has a spring leg 5 and a driving wheel 14. One end 6 of spring leg 5 is pivoted in a stationary position whereas the other end 7 is braced at a preset adjustment angle alpha against a pivotably mounted curved rail 8'. A connecting lever 15 is mounted on rail 8 so as to pivot in the opposite direction to the direction of action of the spring leg and is operatively secured to wheel 14 by a flexible tension member 17 which can be wound on and unwound from a shaft 16 of wheel 14. The braced end 7 of leg 5 is movable by an adjusting device 9' on the rail 8' and lockable in positions corresponding to various loads on desk top 1. In this case also, the curve of rail 8 is chosen so that, in any position of the braced end 7, the vertical force components operative on the column upper parts 11 are substantially equal, at least in both end positions of top 1.

In both embodiments, the spring leg is a pneumatic spring 5. The rails 8 and 8' are advantageously a double rail. One end 7 of spring 5 has rollers 18 on both sides which rest on the double rail 8. The device for adjusting the braced spring end is a worm drive 9 with a hand wheel 19 or crank 20. The nut 21 for the stationary mounted spindle 22 is connected to the braced end 7.

In the embodiment in FIGS. 1 and 2, guide member 2 on the side of spring 5 is braced against frame 3 via parallelogram guide rods 23.

In the embodiment of FIGS. 4 to 8, spring 5, wheel 14, rail 8, the adjusting device 9, the connecting lever 15 and the tension means 17 operatively connecting lever 15 to wheel 14 or shaft 16 constitute a structural unit and are combined in a U-shaped casing 24 having an external driving wheel 14 and a crank connection for the adjusting device 9. An endless cable 25 is connected to wheel 14 and the telescopic column parts 11. Cable 25 is guided on pulleys 26,27 mounted at the top and bottom of the column lower parts 10. Cable 25 is associated with a schematically indicated locking brake 28, for locking the desk top 1 in the set vertical position. The flexible tension means between the lever 15 and the wheel 14 is a steel cable 17 which is connected to a grooved reel 29 secured to the shaft 16 of wheel 14. The pivot bearing 30 for the curved rail is the shaft 31 for actuating the spindle 22 of drive 9 and it constitutes the crank connection. Bearing 30 is at one end of rail 8', whereas the connecting lever 15 is pivotably mounted at the other end, so that the braced end 7 of spring 5 is always between the two pivot points and ensures adequate bracing owing to the tensile forces engaging via cable 27 and lever 15 and resulting from the load on the desk top. In order to guide cable 17 at the center, the connecting lever 15 is constructed as a double lever and secured to the two side plates of the double curved rail 8'.

While specific embodiments of the invention have been shown and described in detail to illustrate the application of the principles of the invention, it will be understood that the invention may be embodied otherwise without departing from such principles.

What is claimed is:

1. A desk, particularly for work stations, comprising:

a desk top which is vertically adjustable between two end positions and has at least one vertical guide member; a desk frame including spaced-apart columns, each column having a vertical hollow bottom part and a top part telescopic therein;

a cross-member interconnecting said bottom parts;

height adjusting means connected to said cross-member for moving said top part with respect to said bottom part to move said desk vertically, said height adjusting means including a telescopic leg member having a first end pivotally connected with respect to said cross-member and a second end, a curved rail member pivotally mounted with respect to said cross-member, said second end of said telescopic leg member being propped against said curved rail, a spindle actuator means connected with a hand wheel for adjusting the position of the telescopic member second end relative to the rail, thereby pivoting the rail and pivoting the telescopic member, said curved rail defining a curve such that the position of the propped telescopic member and force components acting on the top support elements are essentially equal at each of the spaced-apart columns, a traction wheel mounted for rotation relative to said cross-member, a connection lever pivotally mounted to said curved rail member, said traction wheel being connected to a grooved reel member, said grooved reel member rotating with said traction wheel, a flexible traction wheel actuator element connected to said pivot and connected to said grooved reel, said flexible traction element rolling up and unrolling from said grooved reel to rotate said traction wheel upon movement of said pivot in response to said second end of said telescopic member being adjusted along said rail, rotation of said traction wheel causing said desk top to move vertically.

2. A desk according to claim 1, wherein said telescopic leg comprises a pneumatic spring.

3. A desk according to claim 1, wherein said curved rail comprises a pair of spaced apart rails, said telescopic leg having two rollers engaged on respective ones of said rails.

4. A desk according to claim 1, wherein said telescopic leg comprises a pneumatic spring centrally pivoted on a cross member connecting said two guide members.

5. A desk according to claim 1, wherein said telescopic leg comprises a pneumatic spring, a driving wheel associated with said adjusting device for moving said spring leg and including a connecting lever having tension means operatively connecting said lever to said driving wheel and constituting a structural unit that are combined in a U-shaped casing having an external driving wheel and a crank connection for the adjusting device.

6. A desk according to claim 1, wherein said driving wheel is a pinion for a rack for actuating said telescopic upper parts.

7. A desk according to claim 1, including an endless cable connected between said upper and lower parts, said traction wheel being engaged with said endless cable, guide pulleys arranged for guiding said endless cable between said two upper parts mounted adjacent the tops and bottoms of said upper parts and a cable associated with a locking brake.

8. A desk according to claim 1, wherein said flexible tension means between said connecting lever and said traction wheel comprises a steel cable connected to the grooved reel secured to said shaft for the traction wheel.

9. A desk according to claim 1, wherein the pivot for the curved rail comprises an actuating shaft for the spindle of a worm drive, said shaft comprising a crank connection.

* * * * *